US007196336B2

(12) United States Patent
Chung et al.

(10) Patent No.: US 7,196,336 B2
(45) Date of Patent: Mar. 27, 2007

(54) APPARATUS FOR INJECTING PLASMA GAS IN ATMOSPHERE

(75) Inventors: Kyu Sun Chung, Seoul (KR); Yong Sup Choi, Seoul (KR); Myoung Jae Lee, Seoul (KR)

(73) Assignee: Industry-University Cooperation Foundation Hanyang University, Seoul (KR)

( * ) Notice: Subject to any disclaimer, the term of this patent is extended or adjusted under 35 U.S.C. 154(b) by 0 days.

(21) Appl. No.: 10/556,226

(22) PCT Filed: Apr. 26, 2004

(86) PCT No.: PCT/KR2004/000962

§ 371 (c)(1),
(2), (4) Date: Nov. 9, 2005

(87) PCT Pub. No.: WO2004/100622

PCT Pub. Date: Nov. 18, 2004

(65) Prior Publication Data

US 2006/0219173 A1 Oct. 5, 2006

(30) Foreign Application Priority Data

May 9, 2003 (KR) ..... 10-2003-0029360

(51) Int. Cl.
*G21K 1/08* (2006.01)

(52) U.S. Cl. ..... 250/396 R; 250/398; 250/374; 250/379

(58) Field of Classification Search ..... 250/396 R, 250/398, 374, 379; 315/111.21, 111.71
See application file for complete search history.

(56) References Cited

U.S. PATENT DOCUMENTS 4,429,612 A * 2/1984 Tidman et al. ..... 89/8
6,140,773 A 10/2000 Anders et al.
2005/0127844 A1* 6/2005 Mashima et al. ..... 315/111.41

FOREIGN PATENT DOCUMENTS

KR 2001-60200 A 7/2001

* cited by examiner

*Primary Examiner*—Tuyet Thi Vo
(74) *Attorney, Agent, or Firm*—Volpe And Koenig, P.C.

(57) ABSTRACT

An apparatus for injecting plasma in the atmosphere is provided, including a plurality of dielectric panels (13*a*, 13*b*, 13*c*), and 13*d*, which are disposed in parallel at predetermined intervals, a gas supply portion (14), to which the dielectric panels (13*a*, 13*b*, 13*c*, and 13*d*) are fixed and which supplies a gas to spaces between the dielectric panels (13*a* and 13*b*), between the dielectric panels (13*b* and 13*c*), and between the dielectric panels (13*c* and 13*d*), power electrodes (15*a*, 15*b*, and 15*c*), which are linearly installed near the gas supply portion (14) and between the dielectric panels (13*a* and 13*b*, between the dielectric panels 13*b* and 13*c*, and between the dielectric panels 13*c* and 13*d*), respectively, ground electrodes (16*a*, 16*b*, 16*c*, and 16*d*), which are formed in the ends of the dielectric panels (13*a*, 13*b*, 13*c*, and 13*d*), respectively, and a high frequency generator (17), which applies high frequency power to the power electrodes (15*a*, 15*b*, and 15*c*) and the ground electrodes (16*a*, 16*b*, 16*c*, and 16*d*).

1 Claim, 2 Drawing Sheets

APPARATUS FOR INJECTING PLASMA GAS IN ATMOSPHERE

TECHNICAL FIELD

The present invention relates to an apparatus for injecting plasma in the atmosphere.

BACKGROUND ART

FIG. 1 is a front view of a conventional apparatus for injecting plasma in the atmosphere. FIG. 2 illustrates the conventional apparatus of FIG. 1 viewed from direction A.

As shown in FIGS. 1 and 2, a conventional apparatus for injecting plasma in the atmosphere is manufactured by coupling a pair of dielectric panels 3 and 3 to a gas supply portion 4 and forming plate-type electrodes 2 and 2' on the surfaces of the dielectric panels 3 and 3' such as to be opposite to each other. In this plasma injecting apparatus, when a high frequency power supply portion 1 applies high frequency power to both the plate-type electrodes 2 and 2', and gas flows between the dielectric panels 3 and 3', the gas turns into plasma which is injected from the ends of the dielectric panels 3 and 3'. This plasma is injected into an object, such as a liquid crystal display (LCD), a plasma display panel (PDP), a wafer, or the like, to clean the object.

However, plasma comprised of charged particles is strongly prone to be bound between the dielectric panels 3 and 3' due to an electrical field between the plate-type electrodes 2 and 2'. As a result, even if the gas supply portion 4 continuously supplies gas, plasma is not properly injected from the dielectric panels 3 and 3'.

To overcome this problem, an effort has been made to increase the amount of plasma by using a high voltage and higher frequency. However, the use of a high voltage causes generation of an arc between plasma and the outside, an increase in the power consumption, and the like.

DISCLOSURE OF THE INVENTION

The present invention provides an atmospheric plasma injecting apparatus which can generate plasma by using less power and effectively inject the plasma into the outside.

The atmospheric plasma injecting apparatus comprises a plurality of dielectric panels 13*a*, 13*b*, 13*c*, and 13*d*, a gas supply portion 14, power electrodes 15*a*, 15*b*, and 15*c*, ground electrodes 16*a*, 16*b*, 16*c*, and 16*d*, and a high frequency generator 17. The dielectric panels 13*a*, 13*b*, 13*c*, and 13*d* are disposed in parallel at predetermined intervals. The dielectric panels 13*a*, 13*b*, 13*c*, and 13*d* are fixed to the gas supply portion 14, which supplies a gas to spaces between the dielectric panels 13*a* and 13*b*, between the dielectric panels 13*b* and 13*c*, and between the dielectric panels 13*c* and 13*d*. The power-electrodes 15*a*, 15*b*, and 15*c* are linearly installed near the gas supply portion 14 and between the dielectric panels 13*a* and 13*b*, between the dielectric panels 13*b* and 13*c*, and between the dielectric panels 13*c* and 13*d*, respectively. The ground electrodes 16*a*, 16*b*, 16*c*, and 16*d* are formed in the ends of the dielectric panels 13*a*, 13*b*, 13*c*, and 13*d*, respectively. The high frequency generator 17 applies high frequency power to the power electrodes 15*a*, 15*b*, and 15*c* and the ground electrodes 16*a*, 16*b*, 16*c*, and 16*d*.

BEST MODE FOR CARRYING OUT THE INVENTION

An apparatus for injecting plasma in the atmosphere according to the present invention will now be described in detail with reference to the attached drawings.

Figure 1:
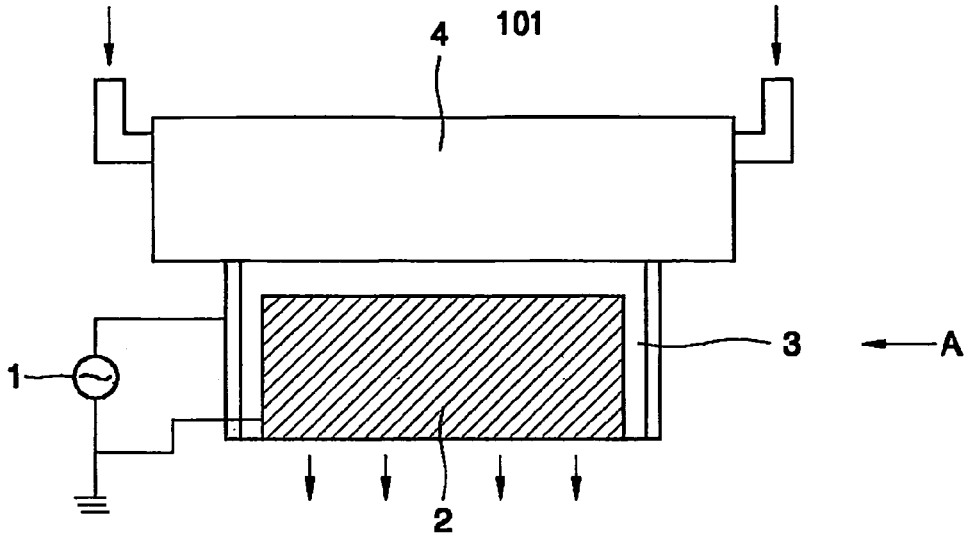
FIG.1 (PRIOR ART)
FIG. 1 is a front view of a conventional apparatus for injecting plasma in the atmosphere.
Figure 2:
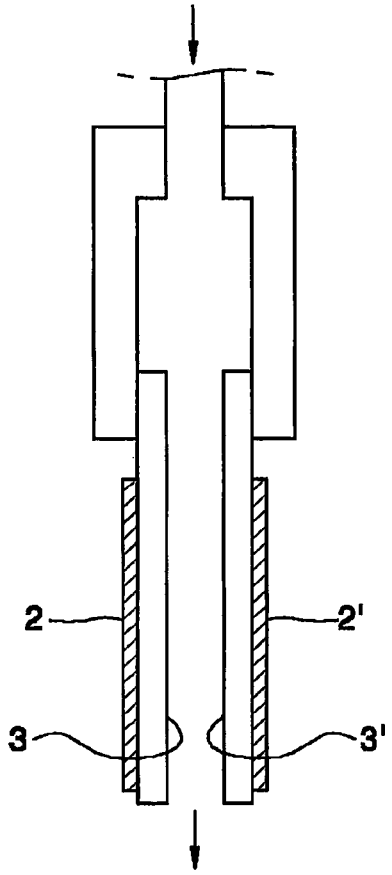
FIG. 2 shows the apparatus of FIG. 1 viewed from direction A.
Figure 3:
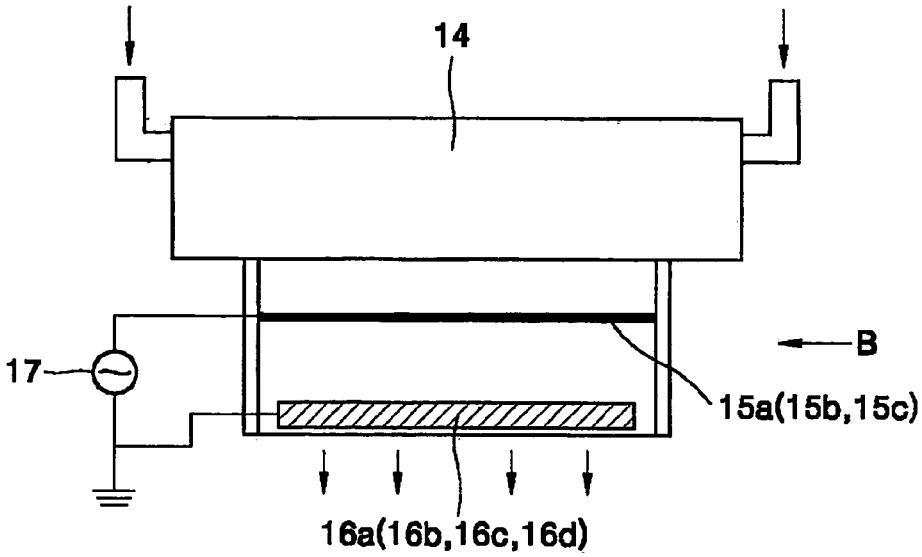
FIG. 3 is a front view of an apparatus for injecting plasma in the atmosphere according to the present invention.
Figure 4:
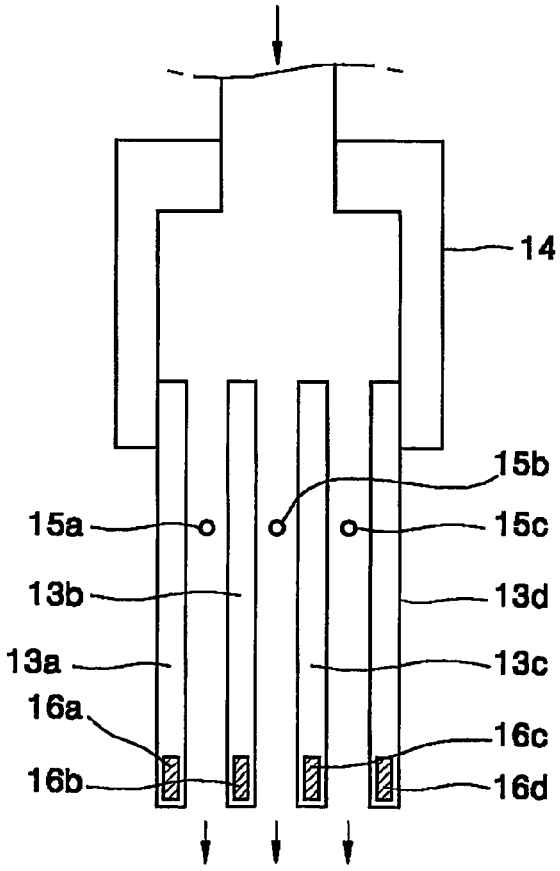
FIG. 4 shows the apparatus of FIG. 3 viewed from direction B.

Referring to FIGS. 3 and 4, an apparatus for injecting plasma in the atmosphere according to an embodiment of the present invention includes a plurality of dielectric panels, for example, four dielectric panels 13*a*, 13*b*, 13*c*, and 13*d*, a gas supply portion 14, power electrodes 15*a*, 15*b*, and 15*c*, ground electrodes 16*a*, 16*b*, 16*c*, and 16*d*, and a high frequency generator 17. The dielectric panels 13*a*, 13*b*, 13*c*, and 13*d* are vertically disposed at a predetermined interval in parallel to each other and fixed to the gas supply portion 14. The gas supply portion 14 supplies a gas to the space between dielectric panels 13*a* & 13*b*, 13*b* & 13*c*, and 13*c* & 13*d*. The power electrodes 15*a*, 15*b*, and 15*c* are linearly installed between dielectric panels 13*a* & 13*b*, 13*b* & 13*c*, and 13*c* & 13*d*, respectively, such as to be close to the gas supply portion 14. The ground electrodes 16*a*, 16*b*, 16*c*, and 16*d* are formed in the ends of the dielectric panels 13*a*, 13*b*, 13*c*, and 13*d*, respectively. The high frequency generator 17 applies high frequency power to the power electrodes 15*a*, 15*b*, and 15*c* and the ground electrodes 16*a*, 16*b*, 16*c*, and 16*d*.

The dielectric panels 13*a*, 13*b*, 13*c*, and 13*d* must have excellent insulating characteristics.

As described above, the gas supply portion 14 injects a gas into the space between dielectric panels 13*a* & 13*b*, 13*b* & 13*c*, and 13*c* & 13*d*. The gas may be various types of gases, such as, an inert gas (e.g., argon), oxygen, hydrogen, a compound gas, and the like.

The power electrodes 15*a*, 15*b*, and 15*c* are formed linearly, that is, in the form of wires, between dielectric panels 13*a* & 13*b*, 13*b* & 13*c*, and 13*c* & 13*d*, respectively.

The ground electrodes 16*a*, 16*b*, 16*c*, and 16*d* are formed in the ends of the dielectric panels 13*a*, 13*b*, 13*c*, and 13*d*, respectively. More specifically, the ground electrodes 16*a*, 16*b*, 16*c*, and 16*d* may be coated on the ends of the dielectric panels 13*a*, 13*b*, 13*c*, and 13*d* or inserted into the ends thereof.

The high frequency generator 17 applies high frequency power with a frequency of several to several hundreds of kHz to the power electrodes 15*a*, 15*b*, and 15*c* and the ground electrodes 16*a*, 16*b*, 16*c*, and 16*d*. In this embodiment, power with a 32 kHz frequency is applied thereto.

In this structure, when the high frequency generator 17 applies high frequency power to the power electrodes 15*a*, 15*b*, and 15*c* and the ground electrodes 16*a*, 16*b*, 16*c*, and 16*d*, and the gas supply portion 4 applies a gas to the space between dielectric panels 13*a* & 13*b*, 13*b* & 13*c*, and 13*c* & 13*d*, the gas turns into conductive plasma. The conductive plasma is injected from the ends of the dielectric panels 13*a*, 13*b*, 13*c*, and 13*d* to the outside.

At this time, a high voltage with a high frequency applied to the power electrodes 15*a*, 15*b*, and 15*c* flows along with the conductive plasma produced between the power electrodes 15*a*, 15*b*, and 15*c* and the ground electrodes 16*a*, 16*b*, 16*c*, and 16*d*. In other words, an effect where a voltage formed in the power electrodes 15*a*, 15*b*, and 15*c* moves toward the ground electrodes 16*a*, 16*b*, 16*c*, and 16*d* appears. Also, a short plasma sheathing is formed on surfaces of the dielectric panels 13*a*, 13*b*, 13*c*, and 13*d* where the ground electrodes 16*a*, 16*b*, 16*c*, and 16*d* are located. Because plasma outside the plasma sheathing maintains a high voltage, neutral particles existing in the atmosphere in contact with the plasma sheathing turn into plasma due to the high voltage. As a result, plasma long in the direction of injection of a gas is obtained. The plasma gas is not easily bound by an electric field between the power electrodes 15*a*, 15*b*, and 15*c* and the ground electrodes 16*a*, 16*b*, 16*c*, and 16*d*. Thus, the plasma gas injecting apparatus according to the present invention can inject a plasma gas farther than a conventional plasma injecting apparatus does.

Further, since a plurality of dielectric panels are disposed in parallel, power electrodes are formed at upper sides of the dielectric panels, and ground electrodes are formed on or in the ends of the dielectric panels, a greater amount of gas can turn into plasma.

As described above, a greater amount of plasma gas can be produced and injected farther than in a conventional technique, so that a to-be-processed object in a process such as an LCD manufacture, a PDP manufacture, a semiconductor manufacturing process, a PCB cleaning, a polymer surface modification, or the like, can be effectively cleaned in large quantities.

INDUSTRIAL APPLICABILITY

As described above, in an atmospheric plasma injecting apparatus according to the present invention, power electrodes are formed at upper sides of dielectric panels, ground electrodes are formed on ends of the dielectric panels, and high frequency power is applied to the space between adjacent electrodes.

Hence, a gas applied to the space between adjacent dielectric panels can turn into plasma in the atmosphere. Since an electric field formed by the power electrodes and the ground electrodes is in the same direction as the direction of injection of the gas, the plasma gas can spout out farther than in the conventional technique.

What is claimed is:

1. An apparatus for injecting plasma in the atmosphere, the apparatus comprising:

a plurality of dielectric panels 13*a*, 13*b*, 13*c*, and 13*d*, which are disposed in parallel at predetermined intervals;

a gas supply portion 14, to which the dielectric panels 13*a*, 13*b*, 13*c*, and 13*d* are fixed and which supplies a gas to spaces between the dielectric panels 13*a* and 13*b*, between the dielectric panels 13*b* and 13*c*, and between the dielectric panels 13*c* and 13*d;* power electrodes 15*a*, 15*b*, and 15*c*, which are linearly installed near the gas supply portion 14 and between the dielectric panels 13*a* and 13*b*, between the dielectric panels 13*b* and 13*c*, and between the dielectric panels 13*c* and 13*d*, respectively;

ground electrodes 16*a*, 16*b*, 16*c*, and 16*d*, which are formed in the ends of the dielectric panels 13*a*, 13*b*, 13*c*, and 13*d*, respectively; and a high frequency generator 17, which applies high frequency power to the power electrodes 15*a*, 15*b*, and 15*c* and the ground electrodes 16*a*, 16*b*, 16*c*, and 16*d*.

* * * * *